US006190269B1

(12) United States Patent
Moriyama

(10) Patent No.: US 6,190,269 B1
(45) Date of Patent: Feb. 20, 2001

(54) MULTI-PIECE SOLID GOLF BALL

(75) Inventor: Keiji Moriyama, Fukuchiyama (JP)

(73) Assignee: Sumitomo Rubber Industries, Ltd., Hyogo-ken (JP)

( * ) Notice: Under 35 U.S.C. 154(b), the term of this patent shall be extended for 0 days.

(21) Appl. No.: 09/352,400

(22) Filed: Jul. 14, 1999

(30) Foreign Application Priority Data

Jul. 14, 1998 (JP) ..... 10-198607
Nov. 10, 1998 (JP) ..... 10-319086

(51) Int. Cl.[7] ..... A63B 37/06
(52) U.S. Cl. ..... 473/373; 473/374
(58) Field of Search ..... 473/371, 373, 473/374, 376, 377, 378

(56) References Cited

U.S. PATENT DOCUMENTS 5,255,922 * 10/1993 Proudfit ..... 473/378
5,304,608 * 4/1994 Yabuki et al. ..... 473/372
5,607,366 * 3/1997 Yokota et al. ..... 473/372
5,733,205 * 3/1998 Higuchi et al. ..... 473/376

* cited by examiner

*Primary Examiner*—Jeanette Chapman
*Assistant Examiner*—Raeann Gorden
(74) *Attorney, Agent, or Firm*—Birch, Stewart, Kolasch & Birch LLP

(57) ABSTRACT

The present invention provides a multi-piece solid golf ball having soft and good shot feel when hit at not only high head speed but also low head speed, and excellent flight performance by accomplishing high launch angle and low spin amount. The present invention relates to a multi-piece solid golf ball comprising a center, an intermediate layer formed on the center, and one or more layers of cover covering the intermediate layer, wherein the golf ball has a contact area with a club face of a golf club of 4.5 to 5.5 $cm^2$ and a ratio of spin amount to launch angle (spin amount/launch angle) of 120 to 220 when hit by a No. 1 wood club at a head speed of 40 m/second, and has a ratio of spin amount/launch angle of 150 to 250 when hit by a No. 5 iron club at a head speed of 34 m/second.

10 Claims, 1 Drawing Sheet

MULTI-PIECE SOLID GOLF BALL

FIELD OF THE INVENTION

The present invention relates to a multi-piece solid golf ball. More particularly, it relates to a multi-piece solid golf ball having soft and good shot feel when hit at not only high club head speed but also low club head speed, and having excellent flight performance by exhibiting a high launch angle and a low amount of spin.

BACKGROUND OF THE INVENTION

Many types of golf balls are commercially selling and are typically classified into solid golf balls such as a two-piece golf ball, three-piece golf ball a and the like, and thread wound golf balls. Recently, the two-piece golf ball and three-piece golf ball been designed to attain a long flight distance, while maintaining soft and good shot feel at the time of hitting in comparison to the conventional thread golf ball. Therefore, the two-piece solid golf ball and three-piece golf ball are generally approved of or employed by many golfers. The three-piece golf ball, when compared with the two-piece golf ball, has better shot feel while maintaining excellent flight performance, because the three-piece golf ball can include a broader hardness distribution. The three-piece golf ball has soft and good shot feel when hit by a driver, but has hard and poor shot feel when hit at low club head speed, such as when hit by a putter.

OBJECTS OF THE INVENTION

A main object of the present invention is to provide a multi-piece solid golf ball having soft and good shot feel when hit at not only high club head speed but also low club head speed, and excellent flight performance by attaining a high launch angle and low amount of spin.

According to the present invention, the object described above has been accomplished by adjusting the contact area with a club face of a golf club and a ratio of spin amount to launch angle (spin amount/launch angle) when hit by a No. 1 wood club at a head speed of 40 m/second, and a ratio of spin amount/launch angle when hit by a No. 5 iron club at a head speed of 34 m/second to specified ranges, thereby providing a multi-piece solid golf ball having soft and good shot feel when hit at not only high head speed but also low head speed, and excellent flight performances.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
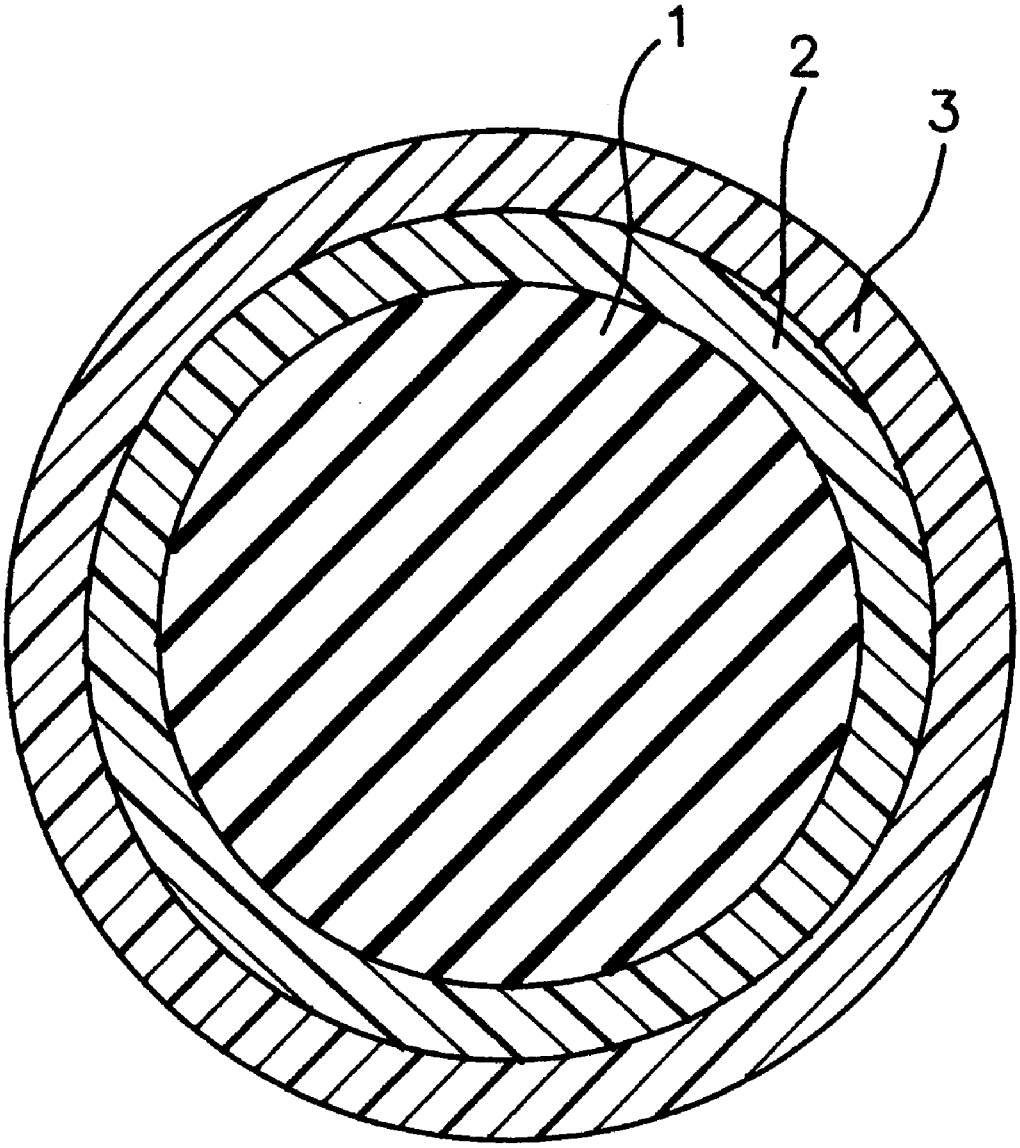
FIG. 1 is a schematic cross section illustrating one embodiment of the golf ball of the present invention.

The present invention provides a multi-piece solid golf ball comprising a center, an intermediate layer formed on the center, and one or more layers of cover covering the intermediate layer, wherein the golf ball has a contact area with a club face of a golf club of 4.5 to 5.5 $cm^2$ and a ratio of spin amount to launch angle (spin amount/launch angle) of 120 to 220 when hit by a No. 1 wood club at a head speed of 40 m/second, and has a ratio of spin amount/launch angle of 150 to 250 when hit by a No. 5 iron club at a head speed of 34 m/second.

In the multi-piece solid golf ball of the present invention, it is preferable that the center 1 has a center hardness in JIS-C hardness of not more than 75 and a surface hardness in JIS-C hardness higher than the center hardness, the difference between the surface hardness and the center hardness is less than 10, the intermediate layer has a JIS-C hardness lower than the surface hardness of the center, the difference between the surface hardness of the center and the intermediate layer hardness is not less than 10, the intermediate layer has a thickness of 0.5 to 2.0 mm, the cover has a thickness of 1.5 to 2.5 mm and a JIS-C hardness higher than that of the intermediate layer, and the hardness difference between the cover and the intermediate layer of 35 to 45.

The multi-piece solid golf ball of the present invention has a contact area with a club face of a golf club of 4.5 to 5.5 $cm^2$, preferably 4.7 to 5.3 $cm^2$, when hit by a No. 1 wood club (a driver) at a head speed of 40 m/second. When the contact area is larger than 5.5 $cm^2$, the flight distance is reduced, and the shot feel is too heavy and poor. When the contact area is smaller than 4.5 $cm^2$, the shot feel is hard and poor.

In addition, the multi-piece solid golf ball of the present invention has the ratio of spin amount to launch angle (spin amount/launch angle) of 120 to 220, preferably 150 to 210, more preferably 180 to 210, most preferably 180 to 200 when hit by a No. 1 wood club (a driver) at a head speed of 40 m/second, and has the ratio of spin amount/launch angle of 150 to 250, preferably 180 to 240, more preferably 200 to 240, most preferably 215 to 240 when hit by a No. 5 iron club at a head speed of 34 m/second. The ratio of spin amount to launch angle (spin amount/launch angle) is an index shown an initial condition of flight performance. When the value of the ratio is larger, the spin amount is higher and the launch angle is lower. On the other hand, when the value of the ratio is smaller, the spin amount is lower and the launch angle is higher. When the ratio when hit by a No. 1 wood club is larger than 220 and the ratio when hit by a No. 5 iron club is larger than 250, the golf ball creates blown-up trajectory, and the flight distance is reduced. When the ratio when hit by a No. 1 wood club is smaller than 120 and the ratio when hit by a No. 5 iron club is smaller than 150, the golf ball is dropped, and the flight distance is reduced.

When hit by a No. 1 wood club (a driver) at a head speed of 40 m/second, the launch angle is 12 to 14 degrees, preferably 12.5 to 13.5 degrees, and the spin amount is 1400 to 3100 rpm, preferably 2300 to 2800 rpm. When hit by a No. 5 iron club at a head speed of 34 m/second, the launch angle is 13 to 15 degrees, preferably 13.5 to 14.5 degrees, and the spin amount is 2000 to 3800 rpm, preferably 2700 to 3500 rpm.

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the multi-piece solid golf ball of the present invention comprises a center 1, an intermediate layer 2 formed on the center 1, and a cover 3 covering the intermediate layer 2. The center 1 is consisted of a rubber composition containing a base rubber, a co-crosslinking agent, an organic peroxide, an organic sulfide compound, a filler, and optionally an antioxidant, and the like.

The base rubber used for the center 1 of the present invention may be natural rubber and/or synthetic rubber, which have been conventionally used for solid golf balls. Preferred is high-cis polybutadiene rubber containing not less than 40 %, preferably not less than 80 % of a cis-1, 4 bond. The high-cis polybutadiene rubber may be mixed with natural rubber, polyisoprene rubber, styrene-butadiene rubber, ethylene-propylene-diene rubber (EPDM) and the like.

The co-crosslinking agent is not limited, but can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. The amount of the co-crosslinking agent in the rubber composition may be from 15 to 30 parts by weight, preferably from 20 to 27 parts by weight, based on 100 parts by weight of the base rubber. When the amount of the co-crosslinking agent is smaller than 15 parts by weight, the center is too soft, and the rebound characteristics are degraded, which reduces flight distance. On the other hand, when the amount of the metal salt of the unsaturated carboxylic acid is larger than 30 parts by weight, the center is too hard, and the shot feel is poor.

The organic peroxide, which acts as a vulcanizing agent or crosslinking agent, includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide may be from 0.5 to 3.0 parts by weight, preferably 0.5 to 2.0 parts by weight, based on 100 parts by weight of the base rubber. When the amount of the organic peroxide is smaller than 0.5 parts by weight, the center is too soft, and the rebound characteristics are degraded, which reduces flight distance. On the other hand, when the amount of the organic peroxide is larger than 3.0 parts by weight, the center is too hard, and the shot feel is poor.

The filler, which can be typically used for the core of golf balls, includes for example, an inorganic filler (such as zinc oxide, barium sulfate, calcium carbonate and the like), a high specific gravity metal powder filler (such as tungsten powder, molybdenum powder, and the like), and the mixture thereof. The amount of the filler may be from 5 to 60 parts by weight, preferably 10 to 55 parts by weight, based on 100 parts by weight of the base rubber. When the amount of the filler is smaller than 5 parts by weight, the weight of the center is light, and the weight of the golf ball is light. On the other hand, when the amount of the filler is larger than 60 parts by weight, the weight of the center is heavy, and the weight of the golf ball is heavy.

The rubber composition for the center of the golf ball of the present invention can contain other components, which have been conventionally used for preparing the core of solid golf balls, such as antioxidants or peptizing agents. If used, the amount of the antioxidant is preferably 0.2 to 0.5 parts by weight, based on 100 parts by weight of the base rubber.

The center 1 is obtained by mixing the above rubber composition with a mixing roll and the like, and then vulcanizing and press-molding the mixture in a mold. It is preferable that the center 1 of the golf ball of the present invention has a center hardness in JIS-C hardness of not more than 75 and a surface hardness in JIS-C hardness higher than the center hardness, the difference between the surface hardness and the center hardness is less than 10. When the center hardness of the center is more than 75, the shot feel of the resulting golf ball is hard and poor. When the difference between the surface hardness and the center hardness is not less than 10, the rebound characteristics of the resulting golf ball are degraded, which reduces flight distance. When the center hardness of the center is too low, the golf ball has long contact time with a face of the golf club, and the shot feel is heavy and poor because the deformation amount at the time of hitting is too large. Therefore the center hardness of the center is preferably not less than 60, more preferably not less than 66. On the other hand, when the center hardness of the center is too high, the shot feel at the time of hitting is hard and poor. Therefore the center hardness of the center is preferably not more than 84, more preferably not more than 79. When the surface hardness of the center is too low, the rebound characteristics of the resulting golf ball are degraded, which reduces flight distance. Therefore the surface hardness of the center is preferably not less than 60, more preferably not less than 72. The center hardness of the center is determined by measuring a hardness at the center point of the center, after the center is cut into two equal parts. The intermediate layer 2 is then formed on the center 1.

The material used for the intermediate layer 2 of the present invention is not limited, but includes ionomer resin, polyurethane thermoplastic elastomer, polyamide thermoplastic elastomer, polyester thermoplastic elastomer, styrene-butadiene-styrene (SBS) structured block copolymers having polybutadiene block with epoxy groups or styrene-isoprene-styrene (SIS) block copolymers having polyisoprene block with epoxy groups, thermoplastic elastomer having terminal OH groups and the like, or the mixture thereof.

The ionomer resin may be a copolymer of α-olefin and α,β-unsaturated carboxylic acid having 3 to 8 carbon atoms, of which a portion of carboxylic acid groups is neutralized with metal ion. Examples of the α-olefins in the ionomer preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1705, Hi-milan 1706, Hi-milan 1707, Hi-milan 1855, Hi-milan 1856 and the like. Examples of the ionomer resins, which are commercially available from Du Pont Co., include Surlyn AD8511, Surlyn AD8512 and the like. Examples of the ionomer resins, which are commercially available from Exxon Chemical Co., include Iotek 7010, Iotek 8000 and the like. These ionomer resins may be used alone or in combination.

The intermediate layer may optionally contain fillers and the like, in addition to the resin component as main component. Examples of fillers include inorganic filler (such as zinc oxide, barium sulfate, calcium carbonate and the like), high specific gravity metal powder filler (such as tungsten powder, molybdenum powder and the like), and the mixture thereof.

The intermediate layer 2 of the present invention may be formed by conventional methods, which have been known in the art and used for forming the cover of the golf balls. For example, there can be used a method which comprises the steps of molding the intermediate layer composition into a semi-spherical half-shell, covering the center with the two half-shells, followed by pressure molding, or a method of injection molding the intermediate layer composition directly on the center to cover it.

In the golf ball of the present invention, it is preferable that the intermediate layer 2 has a thickness of 0.5 to 2.0 mm, preferably 1.0 to 1.8 mm. When the thickness of the intermediate layer 2 is smaller than 0.5 mm, the shot feel is hard and poor. On the other hand, when the thickness of the intermediate layer 2 is larger than 2.0 mm, the rebound characteristics of the resulting golf ball are degraded, which reduces flight distance. In the golf ball of the present invention, it is preferable that the intermediate layer 2 has the JIS-C hardness lower than the surface hardness of the center, and the difference between the surface hardness of the center and the intermediate layer hardness is not less than 10. When the hardness difference is less than 10, the shot feel is hard and poor. When the hardness difference is too large, the contact area with a club face of a golf club at the time of hitting is too large, the spin amount is high, and the golf ball creates a blow-up trajectory which reduces flight distance. Therefore the hardness difference is preferably not more than 49, more preferably not more than 24. When the hardness of the intermediate layer is too low, the rebound characteristics of the golf ball are degraded, which reduces flight distance. Therefore the hardness of the intermediate layer is preferably not less than 35, more preferably not less than 53. On the other hand, when the hardness of the intermediate layer is too high, the shot feel is hard and poor. Therefore the hardness of the intermediate layer is preferably not more than 74, more preferably not more than 55. The cover 3 is then covered on the intermediate layer 2.

The material used for the cover 3 of the present invention is not limited, but includes ionomer resin, which has been conventionally used for solid golf ball cover. Examples of the ionomer resins include those, which are the same ionomer resins as used for the intermediate layer 2.

The cover used in the present invention may optionally contain fillers (such as barium sulfate, calcium carbonate, etc.), pigments (such as titanium dioxide, etc.), and the other additives such as a dispersant, an antioxidant, a UV absorber, a photostabilizer and a fluorescent agent or a fluorescent brightener, etc., in addition to the resin component, as long as the addition of the additive does not deteriorate the desired performance of the golf ball cover. However, the amount of the pigment is preferably 0.1 to 5.0 parts by weight, based on 100 parts by weight of the resin component for the cover.

In the golf ball of the present invention, it is preferable that the JIS-C hardness of the cover 3 is higher than that of the intermediate layer 2, and the hardness difference between the cover and the intermediate layer is 35 to 45, preferably 38 to 42. When the hardness difference is larger than 45, the durability is degraded. On the other hand, when the hardness difference is smaller than 35, the shot feel is poor. When the cover hardness is too low, the rebound characteristics of the golf ball are degraded, the launch angle is low and the spin amount is reduced which reduces flight distance. Therefore the cover hardness is preferably not less than 70, more preferably not more than 93. When the cover hardness is too high, the shot feel of the golf ball is hard and poor. Therefore the cover hardness is preferably not more than 100, more preferably not more than 97. The cover 3 has a thickness of 1.5 to 2.5 mm, preferably 1.8 to 2.3 mm. When the thickness is smaller than 1.5 mm, the technical effects accomplished by the presence of the cover are not sufficiently obtained. On the other hand, when the thickness is larger than 2.5 mm, the shot feel is poor. In the golf ball of the present, the thickness of the cover is larger than that of the intermediate layer in order to thin the layer that has lower hardness and lower rebound characteristics, and in order to thicken the layer that has higher hardness and higher rebound characteristics, thereby accomplishing high launch angle by adjusting the hardness of the intermediate layer to lower than that of the cover A method of covering the intermediate layer with the cover 3 is not specifically limited, but may be the same method as used in the intermediate layer. At the time of molding the cover, many depressions called "dimples" may be optionally formed on the surface of the golf ball. Furthermore, paint finishing or marking with a stamp may be optionally provided after the cover is molded for commercial purposes. The multi-piece solid golf ball of the present invention is formed, so that it has a diameter of not less than 42.67 mm and a weight of not more than 45.93 g, according to the PGA rule.

EXAMPLES

The following Examples and Comparative Examples further illustrate the present invention in detail but are not to be construed to limit the scope of the present invention.

Examples 1 to 6 and Comparative Example 1

Production of Center

The rubber compositions for the center having formulations shown in Table 1 were mixed with a mixing roll, and then vulcanized by press-molding at 144° C. for 19 minutes, and then 165° C. for 8 minutes to obtain spherical centers having a diameter of 35.1 mm. The center hardness and surface hardness of the resulting center were measured. The results are shown in Table 3.

Formation of Intermediate Layer

The formulation materials for the intermediate layer shown in Table 1 were mixed using a kneading type twin-screw extruder to obtain pelletized intermediate layer compositions. The extrusion condition was, a screw diameter of 45 mm, a screw speed of 200 rpm, and a screw L/D of 35.

The formulation materials were heated at 200 to 260° C. at the die position of the extruder. The resulting intermediate layer compositions were injection molded on the centers to form intermediate layers. The thickness and JIS-C hardness of the resulting intermediate layers were measured. The results are shown in Table 3. The test methods are described later.

TABLE 1

(parts by weight)

| | Example No. | | | | | | Com. Ex. No. |
|---|---|---|---|---|---|---|---|
| | 1 | 2 | 3 | 4 | 5 | 6 | 1 |
| (Center composition) | | | | | | | |
| BR-11 *1 | 100 | 100 | 100 | 100 | 100 | 100 | 100 |
| Zinc acrylate | 25.5 | 22.5 | 22.5 | 21 | 22.5 | 17.0 | 28 |
| Zinc oxide | 18.9 | 20.08 | 20.08 | 20.63 | 18.9 | 22.10 | 18.7 |
| Antioxidant *2 | 0.5 | 0.5 | 0.5 | 0.5 | 0.5 | 0.5 | 0.5 |
| Dicumyl peroxide | 2.0 | 2.0 | 2.0 | 2.0 | 2.0 | 2.0 | 2.0 |
| Diphenyl disulfide | 0.5 | 0.5 | 0.5 | 0.5 | 0.5 | 0.5 | 0.5 |
| (Intermediate layer composition) | | | | | | | |
| Elastoran ET880 *3 | 100 | 100 | 100 | 100 | 100 | 100 | 100 |
| Tungsten | 15.7 | 15.7 | 15.7 | 15.7 | 15.7 | 15.7 | 15.7 |

*1: High-cis Polybutadiene rubber (trade name "BR-11") available from JSR Co., Ltd.
*2: Antioxidant (trade name "Yoshinox 425") from Yoshitomi Pharmaceutical Industries, Ltd.
*3: Polyurethane elastomer (trade name "Elastoran ET880") available from Takeda Verdishe Urethane Industries, Ltd.

Preparation of Cover Composition

The formulation materials shown in Table 2 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder. The JIS-C hardness of the resulting cover compositions was shown in Table 3. The test methods are described later.

TABLE 2

(parts by weight)

| | Example No. | | | | | | Com. Ex. No. |
|---|---|---|---|---|---|---|---|
| | 1 | 2 | 3 | 4 | 5 | 6 | 1 |
| (Cover composition) | | | | | | | |
| Hi-milan 1706 *4 | 30 | 43.75 | 38 | 30 | 38 | 30 | — |
| Hi-milan 1605 *5 | 40 | 43.75 | 38 | 40 | 38 | 40 | 5 |
| Hi-milan 1707 *6 | 30 | — | — | 30 | — | 30 | — |
| Hi-milan 1555 *7 | — | 6.25 | — | — | — | — | 10 |
| Hi-milan 1557 *8 | — | 6.25 | — | — | — | — | — |
| Hi-milan 1855 *9 | — | — | 24 | — | 24 | — | 85 |

*4: Hi-milan 1706 (trade name), ethylene-methacrylic acid copolymer ionomer resin obtained by neutralizing with zinc ion, manufactured by Mitsui Du Pont Polychemical Co., Ltd.
*5: Hi-milan 1605 (trade name), ethylene-methacrylic acid copolymer ionomer resin obtained by neutralizing with sodium ion, manufactured by Mitsui Du Pont Polychemical Co., Ltd.

TABLE 2-continued (parts by weight)

| | Example No. | | | | | | Com. Ex. No. |
|---|---|---|---|---|---|---|---|
| | 1 | 2 | 3 | 4 | 5 | 6 | 1 |

*6: Hi-milan 1707 (trade name), ethylene-methacrylic acid copolymer ionomer resin obtained by neutralizing with sodium ion, manufactured by Mitsui Du Pont Polychemical Co., Ltd.
*7: Hi-milan 1555 (trade name), ethylene-methacrylic acid copolymer ionomer resin obtained by neutralizing with sodium ion, manufactured by Mitsui Du Pont Polychemical Co., Ltd.
*8: Hi-milan 1557 (trade name), ethylene-methacrylic acid-isobutyl acrylate terpolymer ionomer resin obtained by neutralizing with zinc ion, manufactured by Mitsui Du Pont Polychemical Co., Ltd.
*9: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.

Production of Golf Ball

The resulting cover compositions were covered on the intermediate layer described above by injection molding. Then, deflashing, surface pretreatment for painting, paint and the like, which are generally done on the surface of a golf ball, were conducted on the surface to produce a golf ball having a weight of 45.4 g and a diameter of 42.7 mm. With respect to the resulting golf balls, the contact area with a club face of golf club and flight performance (launch angle, spin amount and carry) when hit by a No. 1 wood club (W#1, a driver) and a No. 5 iron club (I#5) were measured, and the shot feel at the time of hitting were evaluated. The results are shown in Table 4 (Examples) and Table 5 (Comparative Examples). The test methods are as follows.

Test Method

(1) JIS-C hardness of Intermediate Layer and Cover

The intermediate layer is formed on the center to obtain the intermediate layer-covered center. The intermediate layer hardness is determined by measuring the surface hardness of the resulting intermediate layer-covered center in JIS-C hardness. The cover is covered on the intermediate layer-covered center to obtain the golf ball. The cover hardness is determined by measuring the surface hardness of the resulting golf ball in JIS-C hardness.

(2) Contact Area

The golf ball was hit by a No. 1 wood club (a driver) attached a pressure-sensitive paper on the club face at a head speed of 40 m/second. The contact area is determined by calculating the area of a portion contacted with the golf ball at the time of hitting "S", which is an image formed on the pressure-sensitive paper, using the following formula:

$$S=[½\{(a+b)/2\}]^2$$

wherein "a" is a transverse diameter of the portion contacted with the golf ball, and "b" is a longitudinal diameter of the portion contacted with the golf ball.

(3) Flight Distance

A No.1 wood club (W#1, a driver: Tangent Titanium 270 Loft 10.5° R) was mounted to a swing robot manufactured by True Temper Co. and the resulting golf ball was hit at a head speed of 40 m/second, the launch angle and flight distance to the firstly dropping point on the ground (carry) were measured. The spin amount was measured by continuously taking a photograph of a mark provided on the hit golf ball using a high-speed camera.

A No.5 Iron club (I#5: Maxfly FX-31Σ R) was mounted to a swing robot manufactured by True Temper Co. and the resulting golf ball was hit at a head speed of 34 m/second, launch angle and flight distance (carry) were measured. The spin amount was measured by continuously taking a photograph of a mark provided on the hit golf ball using a high-speed camera.

(4) Shot Feel and Controllability

The shot feel of the golf ball is evaluated by 10 professional golfers according to a practical hitting test using a driver (a No. 1 wood club) and putter. The evaluation criteria are as follows.

Evaluation Criteria

○: Not less than 7 out of 10 golfers felt that the golf ball has soft and good shot feel.

Δ: Not less than 7 out of 10 golfers felt that the golf ball has fairly good shot feel.

X: Not more than 7 out of 10 golfers felt that the golf ball has hard and poor shot feel.

TABLE 3

| | Example No. | | | | | | Com. Ex. No. |
|---|---|---|---|---|---|---|---|
| Test item | 1 | 2 | 3 | 4 | 5 | 6 | 1 |
| (Center) | | | | | | | |
| Center hardness A (JIS-C) | 75 | 71 | 71 | 69 | 66 | 64 | 77 |
| Surface hardness B (JIS-C) | 79 | 72 | 72 | 72 | 75 | 66 | 77 |
| Hardness difference (B-A) | 4 | 1 | 1 | 3 | 9 | 2 | 0 |
| (Intermediate layer) | | | | | | | |
| Thickness (mm) | 1.6 | 1.6 | 1.6 | 1.6 | 1.6 | 1.6 | 1.6 |
| Hardness C (JIS-C) | 55 | 54 | 54 | 53 | 55 | 53 | 56 |
| Hardness difference (B-C) | 24 | 18 | 18 | 19 | 20 | 13 | 21 |
| (Cover) | | | | | | | |
| Thickness (mm) | 2.2 | 2.2 | 2.2 | 2.2 | 2.2 | 2.2 | 2.2 |
| Hardness D (JIS-C) | 97 | 95 | 93 | 97 | 93 | 97 | 85 |
| Hardness difference (D-C) | 42 | 41 | 39 | 44 | 38 | 44 | 29 |

TABLE 4

| | Example No. | | | | | |
|---|---|---|---|---|---|---|
| Test item | 1 | 2 | 3 | 4 | 5 | 6 |
| (Ball) | | | | | | |
| Contact area ($cm^2$) | 4.6 | 4.8 | 4.9 | 5.2 | 5.3 | 5.5 |
| Flight performance (W#1, 40 m/sec) | | | | | | |
| Spin amount (rpm) | 2751 | 2558 | 2458 | 2410 | 2380 | 2254 |

TABLE 4-continued

| | Example No. | | | | | |
|---|---|---|---|---|---|---|
| Test item | 1 | 2 | 3 | 4 | 5 | 6 |
| Launch angle (degree) | 12.8 | 13.0 | 13.2 | 13.3 | 13.0 | 13.8 |
| Ratio of spin amount/ launch angle | 201 | 197 | 186 | 181 | 183 | 163 |
| Carry (yard) | 191 | 191.5 | 190.5 | 190 | 189.5 | 189.1 |
| Flight performance (I#5, 34 m/sec) | | | | | | |
| Spin amount (rpm) | 3392 | 3259 | 3172 | 3138 | 3200 | 2875 |
| Launch angle (degree) | 14.2 | 14.1 | 14.4 | 14.4 | 14.4 | 14.8 |
| Ratio of spin amount/ launch angle | 239 | 231 | 220 | 218 | 222 | 194 |
| Carry (yard) | 158.5 | 160 | 160 | 160.5 | 159.5 | 157.8 |
| Shot feel | ○ | ○ | ○ | ○ | ○ | ○ |

TABLE 5

| | Comparative Example No. | |
|---|---|---|
| Test item | 1 | 2* |
| (Ball) | | |
| Contact area ($cm^2$) | 4.3 | 4.4 |
| Flight performance (W#1, 40 m/sec) | | |
| Spin amount (rpm) | 2558 | 2555 |
| Launch angle (degree) | 12.7 | 12.7 |
| Ratio of spin amount /launch angle | 201 | 201 |
| Carry (yard) | 186 | 188.5 |
| Flight performance (I#5, 34 m/sec) | | |
| Spin amount (rpm) | 3544 | 3369 |
| Launch angle (degree) | 14.0 | 14.0 |
| Ratio of spin amount /launch angle | 253 | 241 |
| Carry (yard) | 156.5 | 157 |
| Shot feel | X | Δ |

*Two-piece golf ball, which is commercially available.

As is apparent from the comparison of the physical properties of the golf balls of Examples 1 to 6 shown in Table 4 with those of the golf balls of Comparative Examples 1 and 2 shown in Table 5, the golf balls of the present invention of Examples 1 to 6 have longer flight distance when hit by a driver and an iron club, and better shot feel when hit by a driver and a putter than the golf ball of Comparative Examples 1 and 2.

On the other hand, in the golf ball of Comparative Example 1, the shot feel is hard and poor because the center hardness of the center is high and the contact area is small, the rebound characteristics are degraded because the hardness difference of the cover from the intermediate layer is small, and the golf ball creates a blow-up trajectory which reduces flight distance because the ratio of the spin amount/ the launch angle when hit by an iron club is large. In the golf ball of Comparative Example 2, which is commercially available, the shot feel is hard and poor because the contact area is small.

What is claimed is:

1. A multi-piece solid golf ball comprising a center, an intermediate layer formed on the center, and one or more layers of cover covering the intermediate layer, wherein the golf ball has a contact area with a club face of a golf club of 4.5 to 5.5 $cm^2$ and a ratio of spin amount to launch angle (spin amount/launch angle) of 120 to 220 when hit by a No. 1 wood club at a head speed of 40 m/second, and has a ratio of spin amount/launch angle of 150 to 250 when hit by a No. 5 iron club at a head speed of 34 m/second, wherein the center has a center hardness in JIS-C hardness of not more than 75 and a surface hardness in JIS-C hardness higher than the center hardness, the difference between the surface hardness and the center hardness being less than 10, the intermediate layer has a JIS-C hardness lower than the surface hardness of the center, the difference between the surface harness of the center and the intermediate layer hardness being not less than 10, the intermediate layer has a thickness of 0.5 to 2.0 mm, and the cover has a thickness of 1.5 to 2.5 mm.

2. The multi-piece solid golf ball according to claim 1, wherein the cover has a JIS-C hardness higher than that of the intermediate layer, and the hardness difference between the cover and the intermediate layer is 35 to 45.

3. The multi-piece solid golf ball according to claim 1, wherein the center has a center hardness in JIS-C hardness of not less than 60.

4. The multi-piece solid golf ball according to claim 1, wherein the center has a center hardness in JIS-C hardness of not less than 66.

5. The multi-piece solid golf ball according to claim 1, wherein the intermediate layer has a thickness of 1.0 to 1.8 mm.

6. The multi-piece solid golf ball according to claim 1, wherein the hardness of the intermediate layer is not less than 35 and not more than 74 in JIS-C hardness.

7. The multi-piece solid golf ball according to claim 1, wherein the hardness of the intermediate layer is not less than 53 and not more than 55 in JIS-C hardness.

8. The multi-piece solid golf ball according to claim 1, wherein the cover has a thickness of 1.8 to 2.3 mm.

9. The multi-piece solid golf ball according to claim 2, wherein the hardness difference between the cover and the intermediate layer is 38 to 42.

10. The multi-piece solid golf ball according to claim 2, wherein the cover has a JIS-C hardness of not less than 70 and not more than 93.

* * * * *